US011976450B2

(12) United States Patent
Willis

(10) Patent No.: US 11,976,450 B2
(45) Date of Patent: May 7, 2024

(54) MINIATURE SHOWER FOR TODDLERS

(71) Applicant: Aliya Willis, Snellville, GA (US)

(72) Inventor: Aliya Willis, Snellville, GA (US)

( * ) Notice: Subject to any disclaimer, the term of this patent is extended or adjusted under 35 U.S.C. 154(b) by 0 days.

(21) Appl. No.: 17/679,071

(22) Filed: Feb. 23, 2022

(65) Prior Publication Data

US 2022/0268003 A1 Aug. 25, 2022

Related U.S. Application Data

(60) Provisional application No. 63/152,351, filed on Feb. 23, 2021.

(51) Int. Cl.
*E03C 1/06* (2006.01)

(52) U.S. Cl.
CPC ..... *E03C 1/06* (2013.01)

(58) Field of Classification Search
CPC ..... E03C 1/0408; E03C 1/0403
USPC ..... 4/619
See application file for complete search history.

(56) References Cited

U.S. PATENT DOCUMENTS 4,741,289 A * 5/1988 Blose ..... A01K 13/001 4/567
9,216,432 B2 * 12/2015 Lea ..... E03C 1/0408
11,419,460 B2 * 8/2022 Shyka ..... A61H 33/6021

* cited by examiner

*Primary Examiner* — Christine J Skubinna
(74) *Attorney, Agent, or Firm* — Incorporating Innovation LLC; Charlena Thorpe, Esq.

(57) ABSTRACT

Implementations of a miniature shower for toddlers comprise one or more water-emitting walls or panels, which may be moveably connected together, adjustable in size, and/or moveably attached to a frame or support, and may further comprise one or more water source components such as a hose and/or connector. In some implementations, a method of using the miniature shower for toddlers comprises configuring the apparatus by opening apart, adjusting the height or other size, and/or attaching the one or more walls to the support at a desired height or other position, positioning the apparatus on a suitable surface, such as a bathtub bottom, shower floor, or a ground surface, and connecting the apparatus to a suitable water source.

10 Claims, 19 Drawing Sheets

300

300

MINIATURE SHOWER FOR TODDLERS

CROSS REFERENCE TO RELATED APPLICATION

This application claims the benefit of U.S. Patent Application Ser. No. 63/152,351, which was filed on Feb. 23, 2022, and is incorporated herein by reference in its entirety.

TECHNICAL FIELD

This disclosure relates to implementations of a miniature shower for toddlers.

BACKGROUND

There are bathtubs for babies or infants but nothing similar that is easy to use for young or small children such as toddlers to take a bath. Also, young or small children (i.e., toddlers or similar) sometimes prefer another option to only taking a bath such as taking a shower. FIGS. 1A-1H illustrate example existing shower devices that can be used for young or small children.

However, young or small children typically do not like taking a shower with water spraying at or coming down from above their head or while being enclosed in a typical high walled shower stall, such as shown in FIGS. 1E-1H. Furthermore, as shown in FIGS. 1A-1H, existing shower options spray water from a showerhead or similar concentrated source which requires moving the showerhead or the young or small child around to spread the water for showering. Additionally, as shown in FIGS. 1A-1H, existing shower options are not standalone (freestanding, self-standing) on a bathtub bottom (or floor), shower floor, or similar surface and have to be attached to and supported by a wall or similar component for use.

DETAILED DESCRIPTION

Figure 1A:
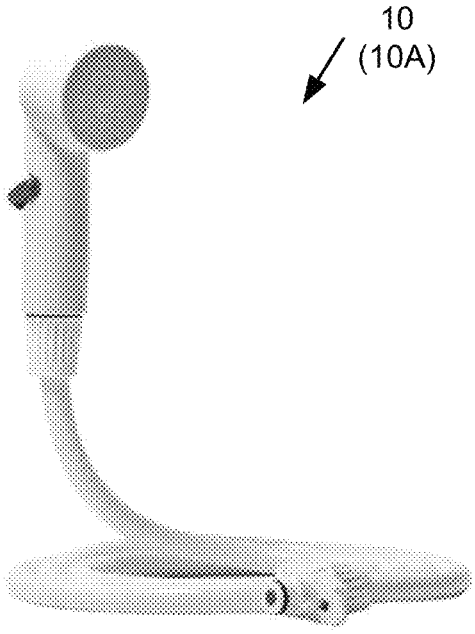
FIG. 1A (PRIOR ART)
FIGS. 1A-1H illustrate example existing shower devices that can be used for young or small children.
Figure 1B:
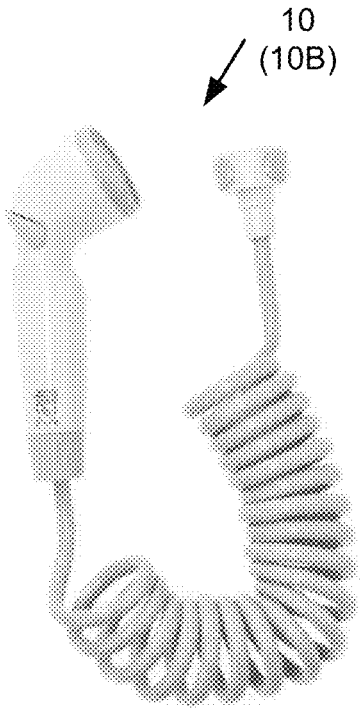
FIG. 1B (PRIOR ART)
Figure 1C:
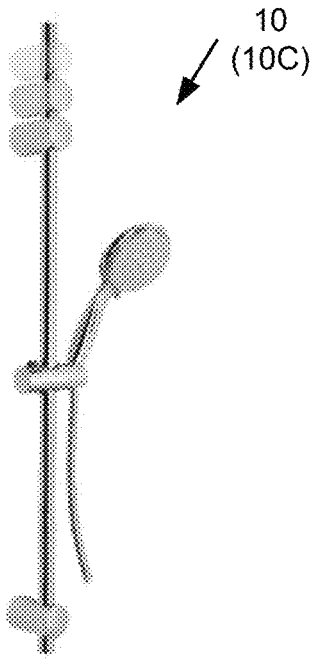
FIG. 1C (PRIOR ART)
Figure 1D:
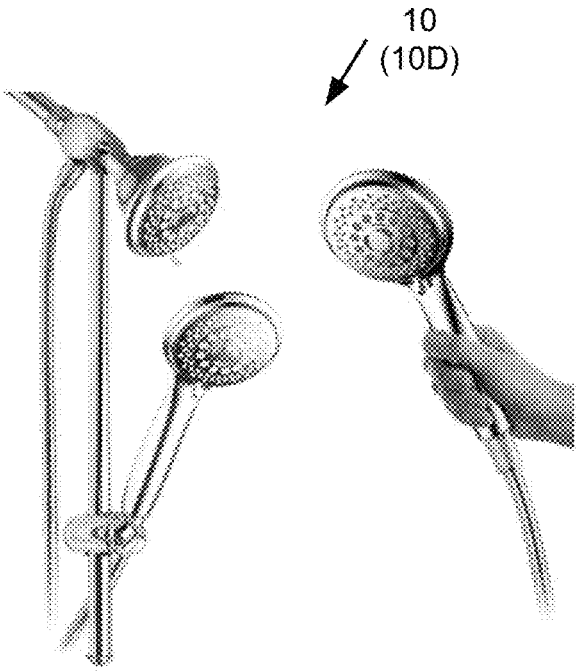
FIG. 1D (PRIOR ART)
Figure 1E:
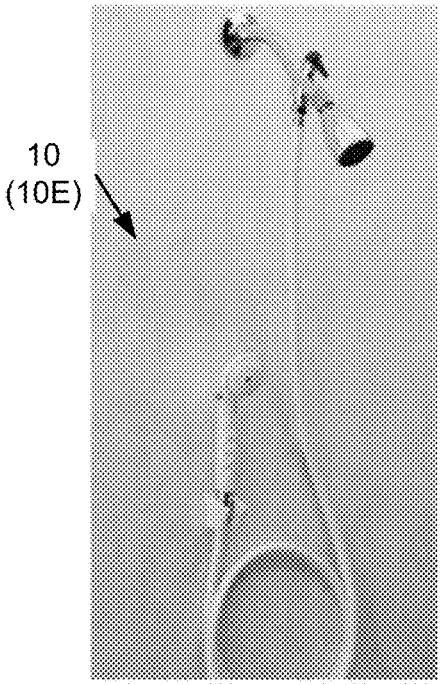
FIG. 1E (PRIOR ART)
Figure 1F:
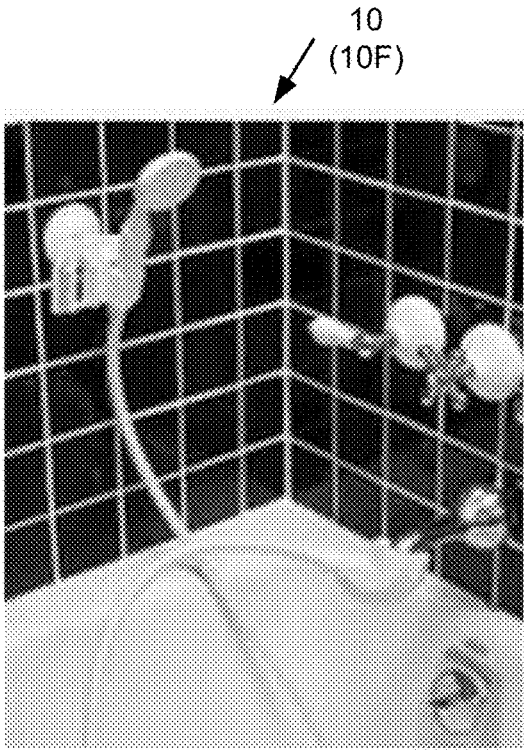
FIG. 1F (PRIOR ART)
Figure 1G:
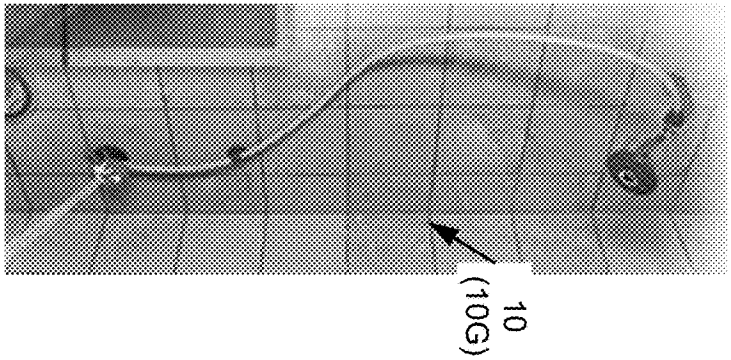
FIG. 1G (PRIOR ART)
Figure 1H:
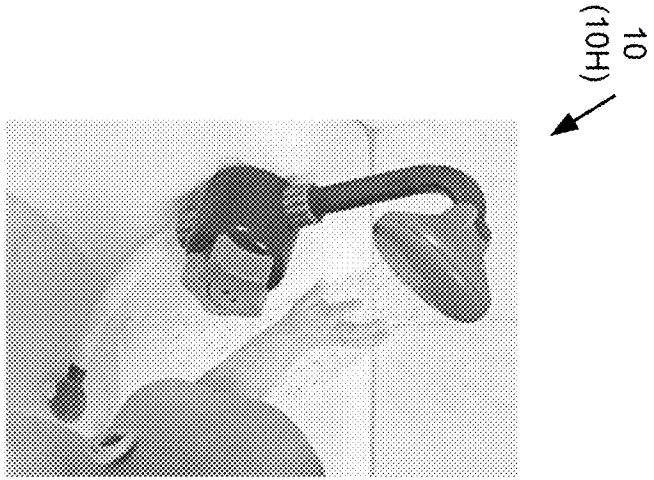
FIG. 1H (PRIOR ART)

Implementations of a miniature shower for toddlers are provided. In some implementations, the miniature shower for toddlers comprises one or more water-emitting walls or panels, which may be moveably connected together, adjustable in size (such as by one or more wall extensions), and/or moveably attached to a frame or support. In some implementations, the miniature shower for toddlers may further comprise one or more water source components such as a hose and/or connector.

In some implementations, the miniature shower for toddlers is configured to provide a miniature shower insert for bathtubs, showers, or other suitable locations for use to shower young or small children such as toddlers.

In some implementations, the miniature shower for toddlers is configured, e.g. sized and shaped, to be used by young or small children, such as age 2 to 6 years old.

In some implementations, the miniature shower for toddlers is portable, such as for carrying or storing the miniature shower for toddlers.

In some implementations, the miniature shower for toddlers is configured to shower a young or small child user by spraying water below the child's head or face.

In some implementations, the miniature shower for toddlers is configured, e.g. sized small enough, such that the miniature shower for toddlers does not cause a young or small child user to feel overwhelmed, anxious, or otherwise uncomfortable during use.

In some implementations, the miniature shower for toddlers is configured to position in a bathtub, shower, or other suitable location and function as a miniature shower for young or small children.

In some implementations, the miniature shower for toddlers is configured to provide a standalone (freestanding, self-standing, etc., as further described below), portable enclosure (or partial enclosure) for a young or small child user to shower.

In some implementations, the miniature shower for toddlers is configured to be adjustable in height.

In some implementations, the miniature shower for toddlers is configured to output water in a spread out or surrounding pattern such that a showerhead or a young or small child user does not have to be moved around to spread the water for showering.

In some implementations, the miniature shower for toddlers is configured to output water at an adjustable height or other configuration for showering.

In some implementations, the miniature shower for toddlers is configured to secure to a bathtub, shower, or other suitable surface, location, etc. by an attachment mechanism, such as suction cups.

In some implementations, the miniature shower for toddlers is configured to connect to a water source, such as a showerhead supply pipe, bathtub water spout, or a water faucet. In some implementations, the miniature shower for toddlers is configured to connect to a plumbing system in general (i.e., any other suitable part thereof), such as a plumbing system of an existing structure such as a house, building, etc.

a water source, such as a plumbing system (e.g., a plumbing system of an existing structure such as a house, building, etc.).

In some implementations, a method of using the miniature shower for toddlers comprises arranging or configuring the apparatus by opening apart, adjusting the height or other size, and/or attaching the one or more walls to the support at a desired height or other position. In some implementations, the method comprises positioning the miniature shower for toddlers on a suitable surface, such as a bathtub bottom (or floor), shower floor, or a ground surface, and connecting the apparatus to a suitable water source, such as a showerhead supply pipe, bathtub water spout, a water faucet, or other part of a plumbing system.

In some implementations, the method comprises positioning a young or small child adjacent to the walls, and showering the child with water delivered from the walls.

There are bathtubs for babies or infants but nothing similar that is easy to use for young or small children such as toddlers to take a bath. Also, young or small children (i.e., toddlers or similar) sometimes prefer another option to only taking a bath such as taking a shower. FIGS. 1A-1H illustrate example existing shower devices 10 that can be used for young or small children.

However, young or small children typically do not like taking a shower with water spraying at or coming down from above their head or while being enclosed in a typical high walled shower stall, such as shown in FIGS. 1E-1H. Furthermore, as shown in FIGS. 1A-1H, existing shower options 10 spray water from a showerhead or similar concentrated source which requires moving the showerhead or the young or small child around to spread the water for showering. Additionally, as shown in FIGS. 1A-1H, existing shower options 10 are not standalone (freestanding, self-standing) on a bathtub bottom (or floor), shower floor, or similar surface and have to be attached to and supported by a wall or similar component for use.

Figure 2A:
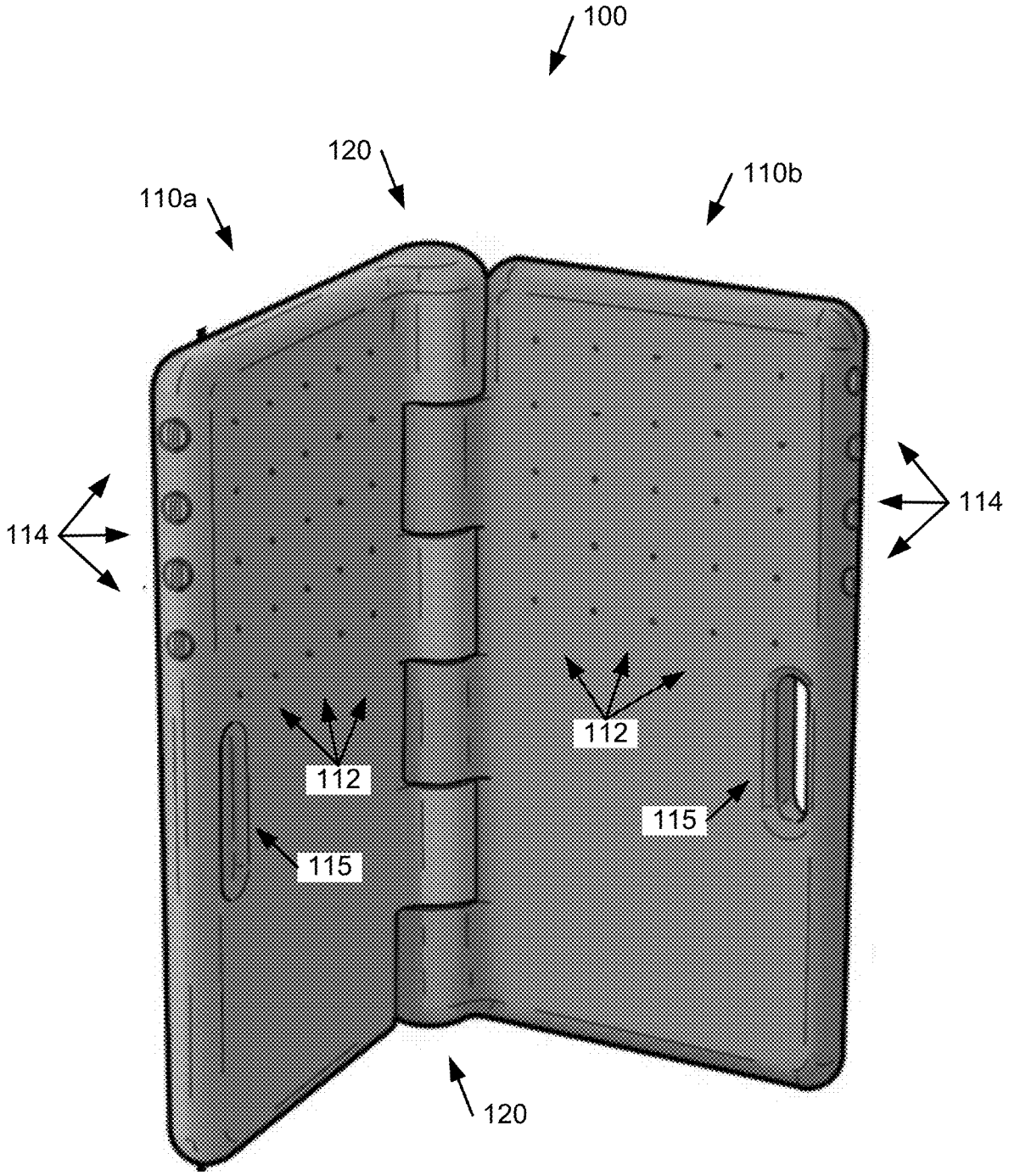
FIGS. 2A-2F illustrate an implementation of an example miniature shower for toddlers according to the present disclosure.

FIGS. 2A-2F illustrate an implementation of an example miniature shower for toddlers according to the present disclosure. As shown in FIG. 2A, in some implementations, the miniature shower for toddlers 100 comprises one or more walls 110, such as a first wall 110*a* and a second wall 110*b*.

In some implementations, the miniature shower for toddlers 100 may also comprise one or more hinges or similar connectors 120. As shown in FIG. 2E, in some implementations, the miniature shower for toddlers 100 may also comprise a water source connector 130.

As shown in FIG. 2A, in some implementations, the miniature shower for toddlers 100 may further comprise one or more wall extensions 150.

As shown in FIG. 2A, in some implementations, the walls 110 comprise one or more water output openings 112 and one or more water input openings 113.

In some implementations, the walls 110 may further comprise one or more water control valves 114. In some implementations, the walls 110 may further comprise one or more handle openings 115.

In some implementations, the walls 110 may further comprise one or more attachment mechanisms such as suction cups or similar detachable connectors (not shown). As shown in FIG. 2C, in some implementations, the walls 110 may further comprise one or more accessory openings 116.

In some implementations, the walls 110 may be any other suitable shape. For example, as shown in FIG. 2A, in some implementations, the walls 110 are generally rectangular prism shaped.

In some implementations, the walls 110 are connected together. In some implementations, the walls 110 are moveably connected together by the hinges (or similar connectors) 120.

As shown in FIG. 2A, in some implementations, the walls 110 are moveably connected together such that the walls 110 can also at least partly open or spread apart by the hinges 120. In some implementations, the walls 110 are moveably connected together such that the walls 110 can open apart to any suitable extent by the hinges 120 for usage of the miniature shower for toddlers 100.

Figure 2B:
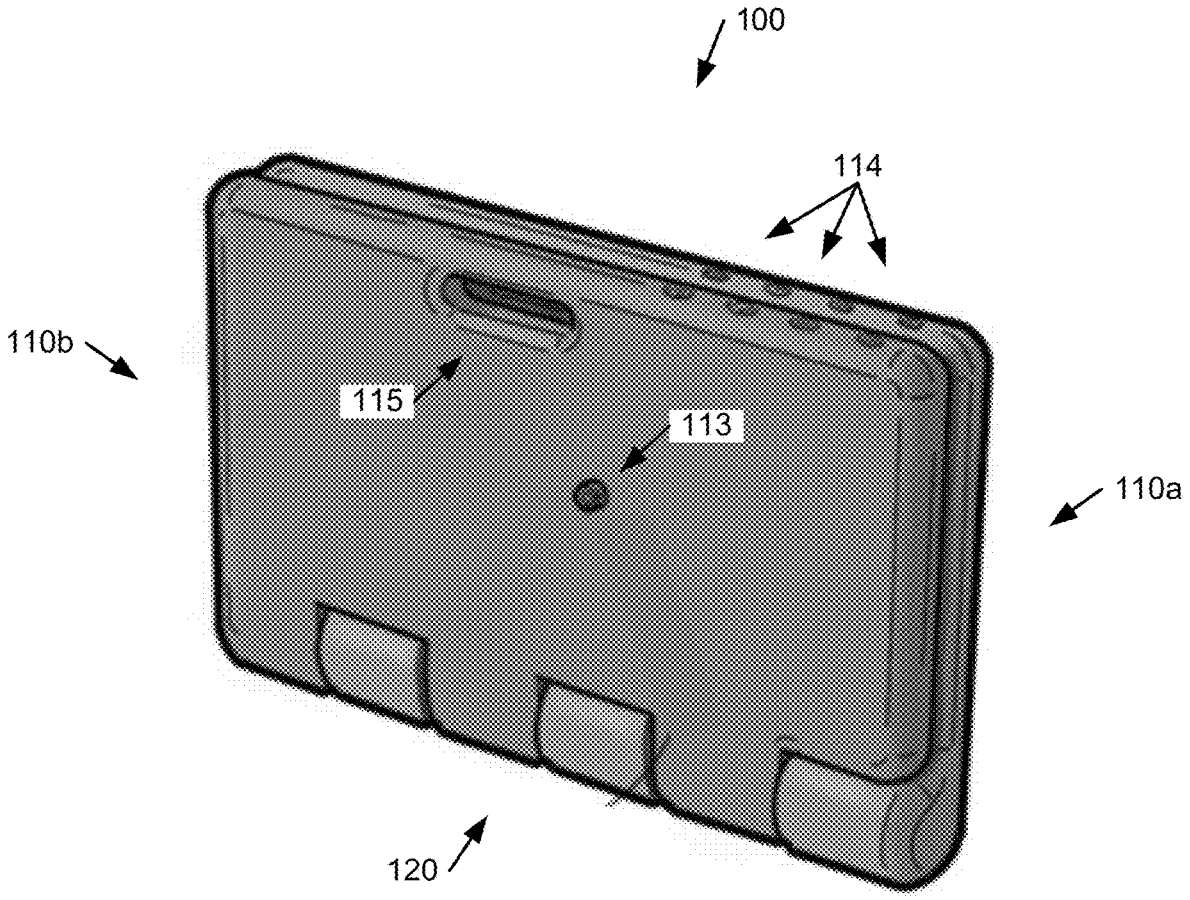
Figure 2E:
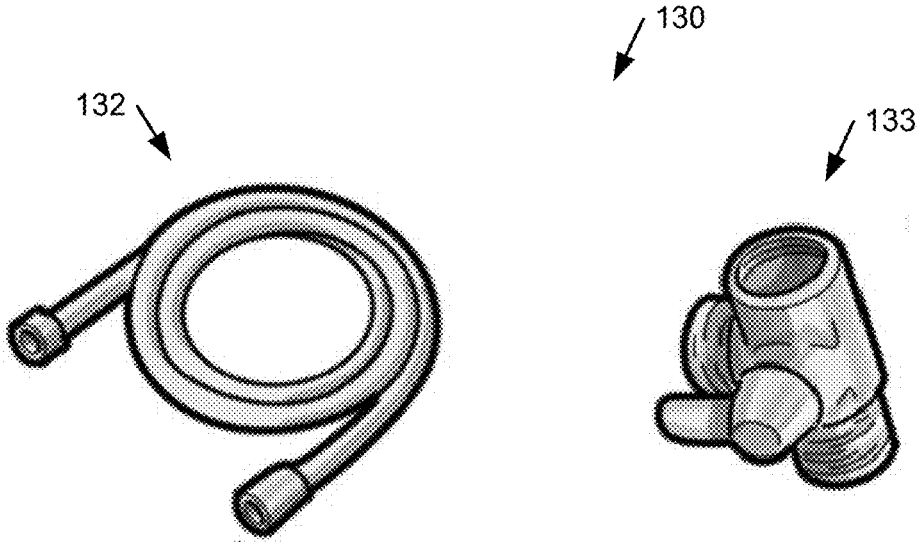

As shown in FIG. 2B, in some implementations, the walls 110 are moveably connected together such that the walls 110 can at least partly close or move together by the hinges 120. In some implementations, the walls 110 are moveably connected together such that the walls 110 can close together to any suitable extent by the hinges 120, such as for carrying or storing the miniature shower for toddlers 100.

In some implementations, the walls 110 are moveably connected together such that the walls 110 can close together in a generally flat configuration.

In some implementations, the walls 110 are configured to provide an enclosure or partial enclosure for showering.

In some implementations, the water output openings 112 may be any other suitable shape. For example, as shown in FIG. 2A, in some implementations, the water output openings 112 are generally circular shaped.

As shown in FIG. 2A, in some implementations, the water output openings 112 are positioned on one side of each wall 110 such that the water output openings 112 can output water toward a user positioned adjacent to the walls 110. In some implementations, the water output openings 112 may be positioned in any other suitable way on the sides of the walls 110.

In some implementations, the water output openings 112 may be positioned in any suitable configuration on the walls 110. For example, as shown in FIG. 2A, in some implementations, the water output openings 112 may be positioned adjacently in a plurality of rows and/or columns.

In some implementations, the water output openings 112 may be positioned adjacently in a plurality of five rows and five columns. In some implementations, the water output openings 112 may be positioned adjacently in any other suitable number of rows and/or columns.

In some implementations, the water output openings 112 may be positioned on the walls 110 such that the water output openings 112 can output water toward below the head of a user of the miniature shower for toddlers 100. For example, in some implementations, the water output openings 112 are suitably positioned lengthwise and/or widthwise on the walls 110 to output water toward below the head of a user.

In some implementations, the water output openings 112 may be positioned on the walls 110 such that the water output openings 112 can output water in any other suitable way.

In some implementations, the water output openings 112 may be configured to output water from the miniature shower for toddlers 100 in any suitable way. For example, in some implementations, the water output openings 112 may be configured to spray water from the miniature shower for toddlers 100. In some implementations, the water output openings 112 may be configured to stream water from the miniature shower for toddlers 100.

In some implementations, the water output openings 112 may be configured to output water from the miniature shower for toddlers 100 in any suitable direction.

In some implementations, the water control valves 114 may comprise any suitable valves that can be used to control the water output of the water output openings 112, such as in the ways described below. For example, in some implementations, the water control valves 114 may comprise any suitable quarter-turn or multi-turn water shutoff valve.

In some implementations, the water control valves 114 may be positioned on and/or within any suitable position of the walls 110. For example, as shown in FIG. 2A, in some implementations, the water control valves 114 may be positioned on the walls 110 such that the water control valves 114 can be turned on and off from an end of one or more of the walls 110. In some implementations, the water control valves 114 may be positioned within the walls 110 such that the water control valves 114 can control the water output from one or more of the water output openings 112.

As shown in FIG. 2A, in some implementations, the water control valves 114 may be positioned and configured such that one or more rows of the water output openings 112 are controlled by an adjacent water control valve 114. In some implementations, the water control valves 114 may be positioned and configured such that any other suitable configuration of the water output openings 112 are controlled by a corresponding water control valve 114.

In some implementations, the water control valves 114 are configured to control the water output openings 112 in any suitable way. For example, in some implementations, the water control valves 114 are configured to turn on and turn off the water output from the water output openings 112. In some implementations, the water control valves 114 may be configured to also variably increase and decrease the water output from the water output openings 112.

In some implementations, the water control valves 114 may be configured to vary the height of the water output from the water output openings 112. For example, in some implementations, the water control valves 114 may be used to decrease or turn off the water output from one or more upper rows of water output openings 112. In some implementations, the water control valves 114 may be configured to vary the water output from the water output openings 112 in any other suitable way.

In some implementations, the water input opening 113 may be any other suitable shape. For example, as shown in FIG. 2B, in some implementations, the water input opening 113 is generally circular shaped.

In some implementations, the water input opening 113 may be positioned at any suitable position of the walls 110. For example, as shown in FIG. 2B, in some implementations, a water input opening 113 may be positioned on one or more of the walls 110 on an opposite side from the water output openings 112.

In some implementations, the water input opening 113 is connected to the water output openings 112 such that water inputted to the miniature shower for toddlers 100 through the water input opening 113 is outputted through the water output openings 112.

In some implementations, the water input opening 113 is configured to connect the miniature shower for toddlers 100 to a water source. For example, as shown in FIG. 2F, in some implementations, the water input opening 113 is configured to connect to the water source connector 130 which connects to a water source 30.

In some implementations, the handle opening 115 may be any other suitable shape. For example, as shown in FIGS. 2A and 2B, in some implementations, the handle opening 115 is generally rectangular shaped.

In some implementations, the handle opening 115 may be positioned at any suitable position of the walls 110. For example, as shown in FIGS. 2A and 2B, in some implementations, a handle opening 115 may be positioned on one or more of the walls 110 in a position that allows a user to carry the miniature shower for toddlers 100. In some implementations, the handle opening 115 may be positioned such that the miniature shower for toddlers 100 can be carried with the walls 110 in a folded or closed together configuration.

In some implementations, the handle opening 115 may also be positioned such that the walls 110 can be opened apart or closed together using the handle opening 115.

In some implementations, the handle opening 115 is configured to allow a user to carry the miniature shower for toddlers 100, such as with the walls 110 in a folded or closed together configuration.

In some implementations, the handle opening 115 is configured to allow a user to open apart or close together the walls 110.

In some implementations, the accessory openings 116 may be any other suitable shape. For example, as shown in FIG. 2C, in some implementations, the accessory openings 116 are generally circular shaped.

In some implementations, the accessory openings 116 may be positioned at any suitable position of the walls 110. For example, as shown in FIG. 2C, in some implementations, the accessory openings 116 may be positioned on the end of the wall 110 that faces downward when the miniature shower for toddlers 100 is used.

In some implementations, the accessory openings 116 are configured to receive the attachment of the wall extensions 150 to the walls 110, as described more below.

In some implementations, the accessory openings 116 may be configured to receive the attachment of the one or more attachment mechanisms such as suction cups.

In some implementations, the one or more attachment mechanisms such as suction cups may be attached to the walls 110 to provide additional stability when the miniature shower for toddlers 100 is used. For example, in some implementations, the suction cups may be attached to the walls 110 by the accessory openings 116 and used to further secure the miniature shower for toddlers 100 to a bathtub or other surface for use.

In some implementations, the attachment mechanisms may alternately comprise feet, supports, or other similar components. In some implementations, the attachment mechanisms may comprise any other suitable components.

In some implementations, the hinges 120 may comprise any suitable hinge or similar connector that can moveably connect the walls 110 together for use of the miniature shower for toddlers 100.

In some implementations, the hinges 120 may be separately attached to the walls 110. As shown in FIGS. 2A and 2B, in some implementations, the hinges 120 may be integrated to the walls 110.

In some implementations, the hinges 120 may be attached to the walls 110 in any other suitable configuration.

In some implementations, the hinges 120 are configured to moveably connect the walls 110 together.

In some implementations, the hinges 120 are configured to secure the walls 110 in an opened apart or closed together position, such as for use, carrying, or storage of the miniature shower for toddlers 100. For example, in some implementations, the hinges 130 may be configured to the secure the walls 110 in a position by friction or other suitable mechanism.

In some implementations, the water source connector 130 may comprise any suitable components that can connect a water source to the miniature shower for toddlers 100 through the water input opening 113. For example, as shown in FIG. 2E, in some implementations, the water source connector 130 may comprise a water hose 132. In some implementations, the water source connector 130 may further comprise a diverter, splitter, or similar connector 133.

In some implementations, the water source connector 130 is configured to connect the miniature shower for toddlers 100 to a water source, such as a showerhead supply pipe (or shower arm), bathtub water spout, or a water faucet. For example, in some implementations, the diverter 133 is configured to connect to a showerhead supply pipe such that the water hose 132 and a showerhead can be connected to the supply pipe by the diverter 133. In some implementations, the water hose 132 may be configured to connect to a bathtub water spout opposite the connection of the hose 132 to the water input opening 113.

In some implementations, the water source connector 130 is configured to connect the miniature shower for toddlers 100 to a plumbing system in general (i.e., any other suitable part thereof), such as a plumbing system of an existing structure such as a house, building, etc.

In some implementations, the water source connector 130 may be configured to connect the miniature shower for toddlers 100 to a water source in any other suitable way.

As shown in FIG. 2C, in some implementations, the wall extensions 150 may comprise one or more attachment prongs 152 or similar components.

In some implementations, the wall extensions 150 are similar shaped to the walls 110. For example, in some implementations, the wall extensions 150 are generally rectangular prism shaped.

In some implementations, the attachment prongs 152 may be positioned at any suitable position of the wall extension 150. For example, as shown in FIG. 2C, in some implementations, the attachment prongs 152 may be positioned on the end of the wall extension 150 that faces upward when the miniature shower for toddlers 100 is used with the wall extension 150 attached.

Figure 2D:
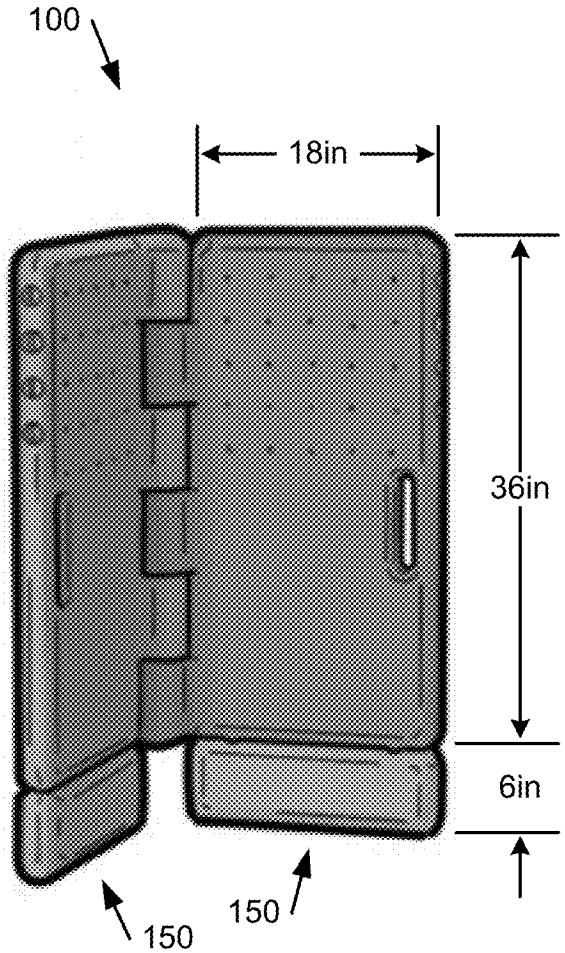
Figure 2C:
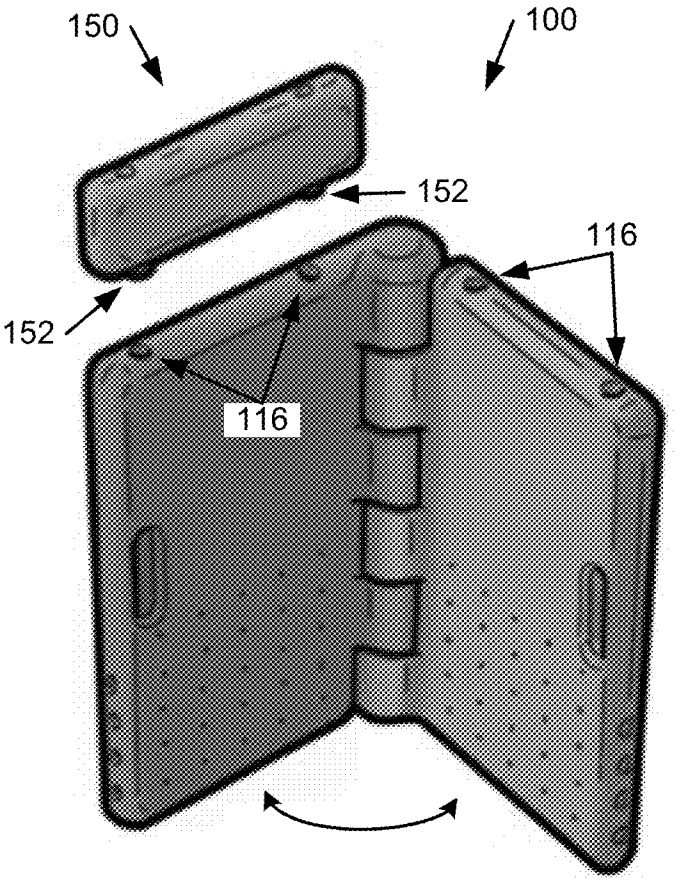
Figure 2F:
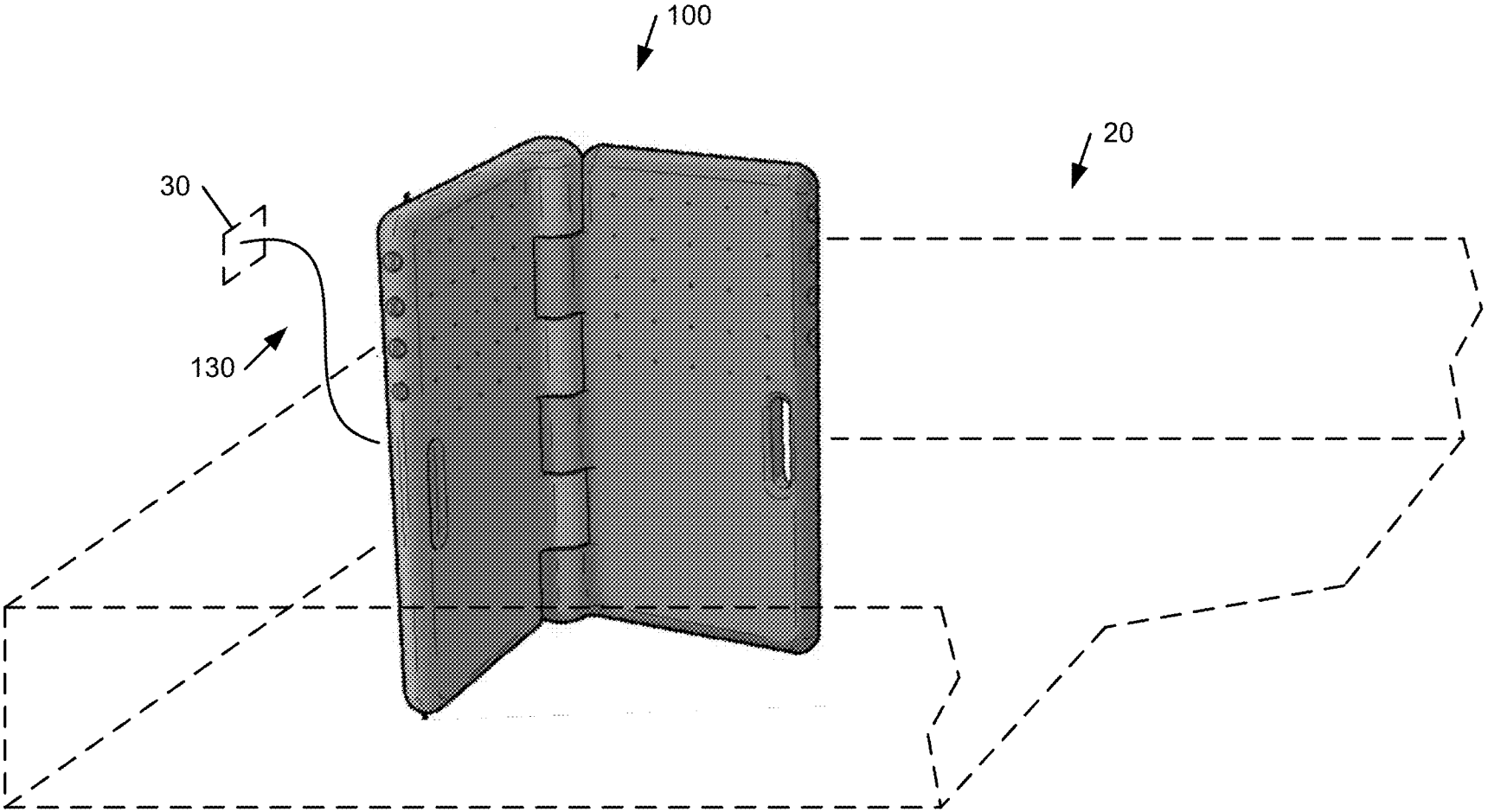

As shown in FIGS. 2C and 2D, in some implementations, the wall extension 150 is configured to attach to a wall 110 by the attachment prong 152 inserting or otherwise attaching to the accessory opening 116.

In some implementations, the wall extension 150 is configured to attach to a wall 110 such that the length of the wall 110 is increased by the addition of the wall extension 150. Thereby, in some implementations, the height of the miniature shower for toddlers 100 from the mounting surface, such as a bathtub bottom (or floor) or shower floor (or a ground surface), can be increased, such as to use the miniature shower for toddlers 100 for a taller or larger young child.

In some implementations, the wall extension 150 is configured to detach from a wall 110 by removing or otherwise detaching the attachment prong 152 from the accessory opening 116.

In some implementations, the wall extensions 150 are configured to stackably attach to further increase the length of the walls 110. In some implementations, the wall extensions 150 are configured to stackably attach in the same or similar way described above for the attachment of a wall extension 150 to a wall 110.

Figure 3A:
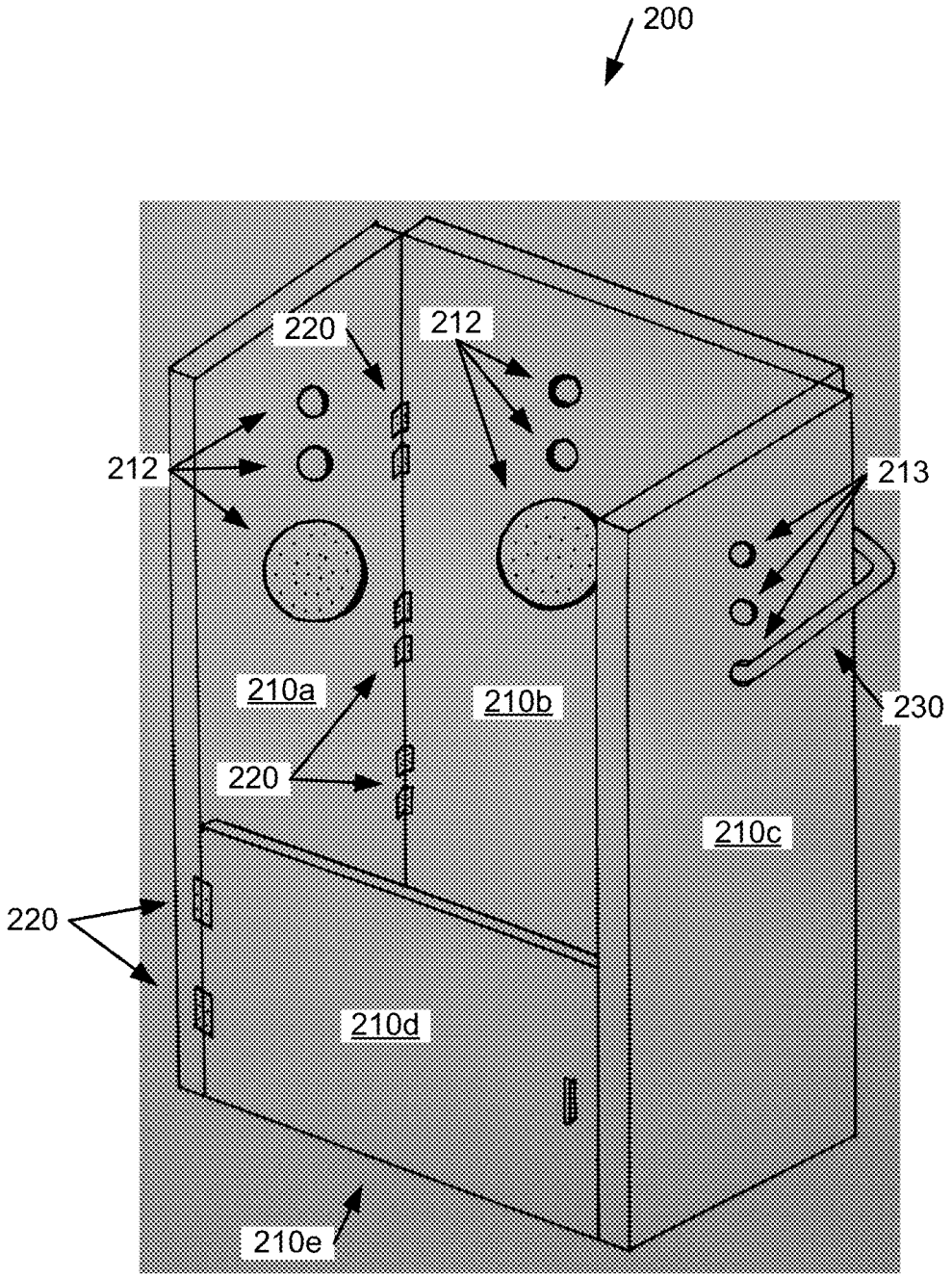
FIGS. 3A and 3B illustrate another implementation of an example miniature shower for toddlers according to the present disclosure.
Figure 3B:
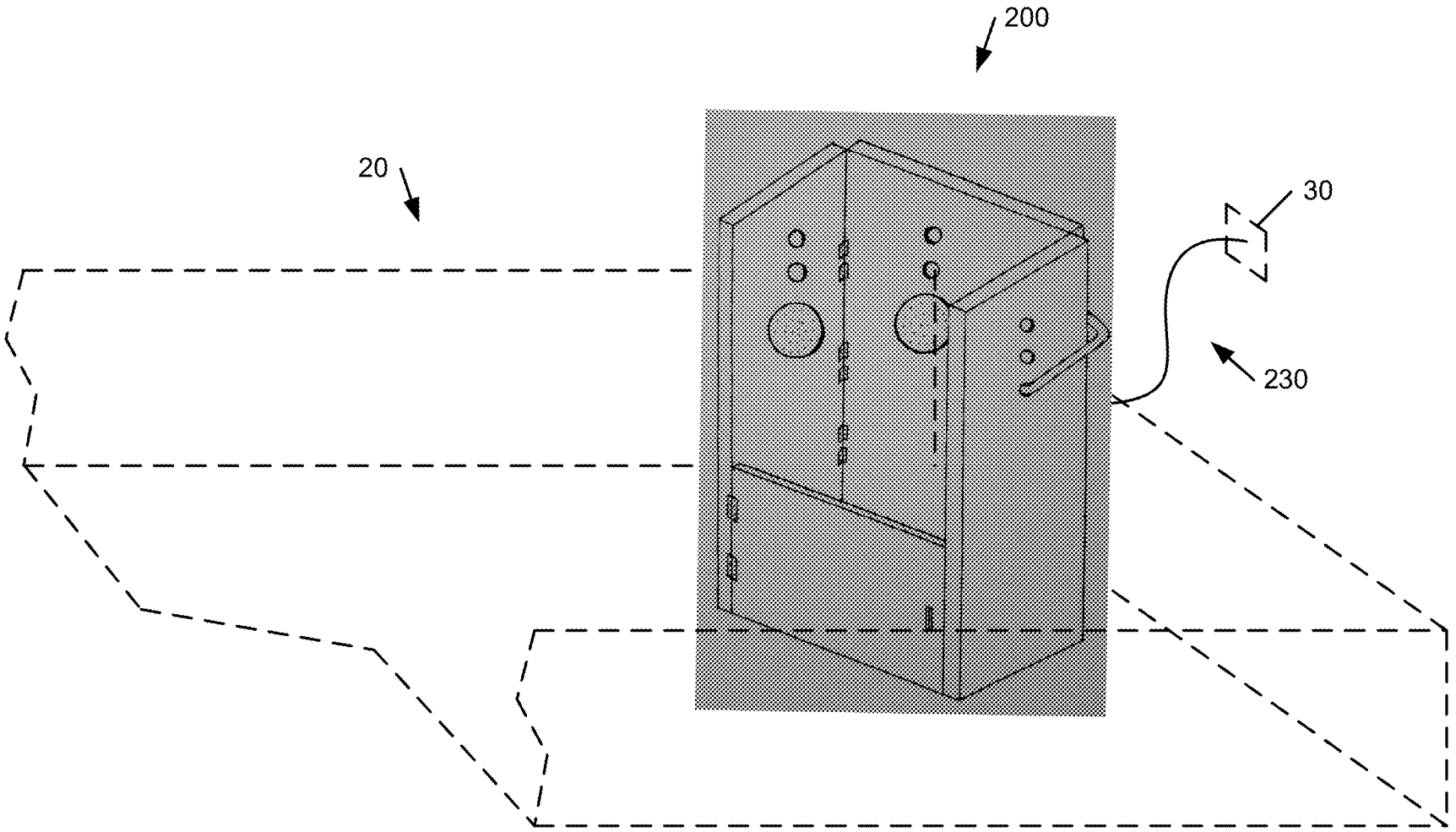

FIGS. 3A and 3B illustrate another implementation of an example miniature shower for toddlers 200 according to the present disclosure. In some implementations, the miniature shower for toddlers 200 is the same or similar to the miniature shower for toddlers 100 described above for FIGS. 2A-2F.

For example, as shown in FIG. 3A, in some implementations, the miniature shower for toddlers 200 comprises one or more walls 210, such as a first wall 210*a*, a second wall 210*b*, and a third wall 210*c*, that are similar to the above described walls 110 of the miniature shower for toddlers 100.

In some implementations, the miniature shower for toddlers 200 may also comprise one or more hinges or similar connectors 220 that are similar to the above described hinges 120 of the miniature shower for toddlers 100. As shown in FIG. 3B, in some implementations, the miniature shower for toddlers 200 may also comprise a water source connector 230 that is similar to the above described water source connector 130 of the miniature shower for toddlers 100.

As shown in FIG. 3A, in some implementations, the miniature shower for toddlers 200 may further comprise a fourth wall or door 210*d*. In some implementations, the miniature shower for toddlers 200 may further comprise a fifth wall or floor 210*e*.

As shown in FIG. 3A, in some implementations, the walls 210 comprise one or more water output openings 212 and one or more water input openings 213 that are similar to the above described water output openings 112 and water input openings 113 of the miniature shower for toddlers 100.

In some implementations, the water openings 212, 213 may be configured to receive a showerhead to receive and deliver water into the enclosure formed by the walls 210. In this way, in some implementations, the showerhead does not have be held by a young or small child user or a parent for showering.

As shown in FIG. 3A, in some implementations, the water openings 212, 213 may be positioned at various heights to adjust the location of the water input and/or output for the miniature shower for toddlers 200. In some implementations, the water openings 212, 213 may be positioned at various heights to receive a showerhead to receive and deliver water from the miniature shower for toddlers 200 at varying heights.

In this way, in some implementations, the miniature shower for toddlers 200 can be adjustable for the size or height of a young or small child user.

Figure 4B:
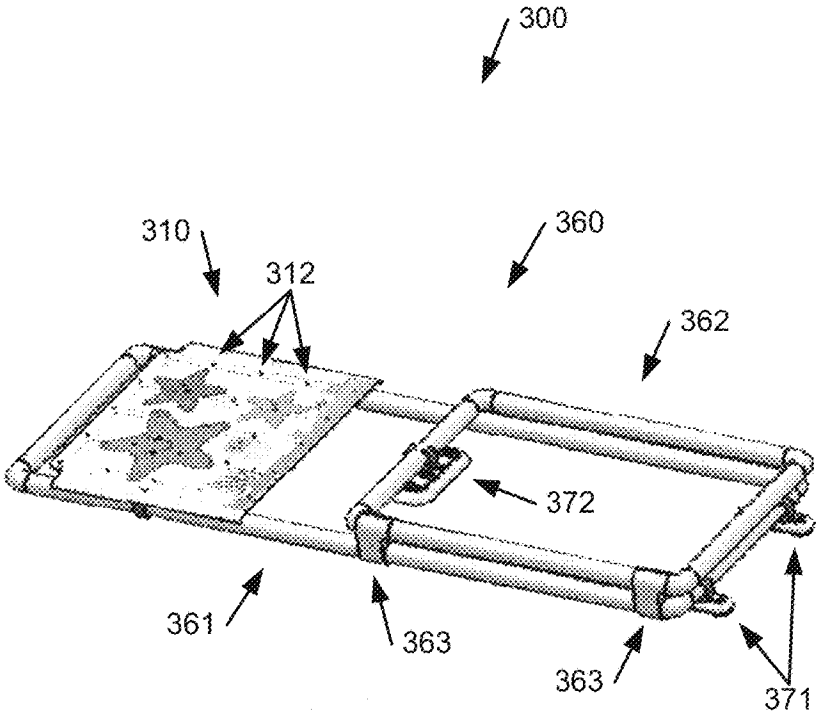
FIGS. 4A-4G and 5A-5H illustrate another implementation of an example miniature shower for toddlers according to the present disclosure.
Figure 4A:
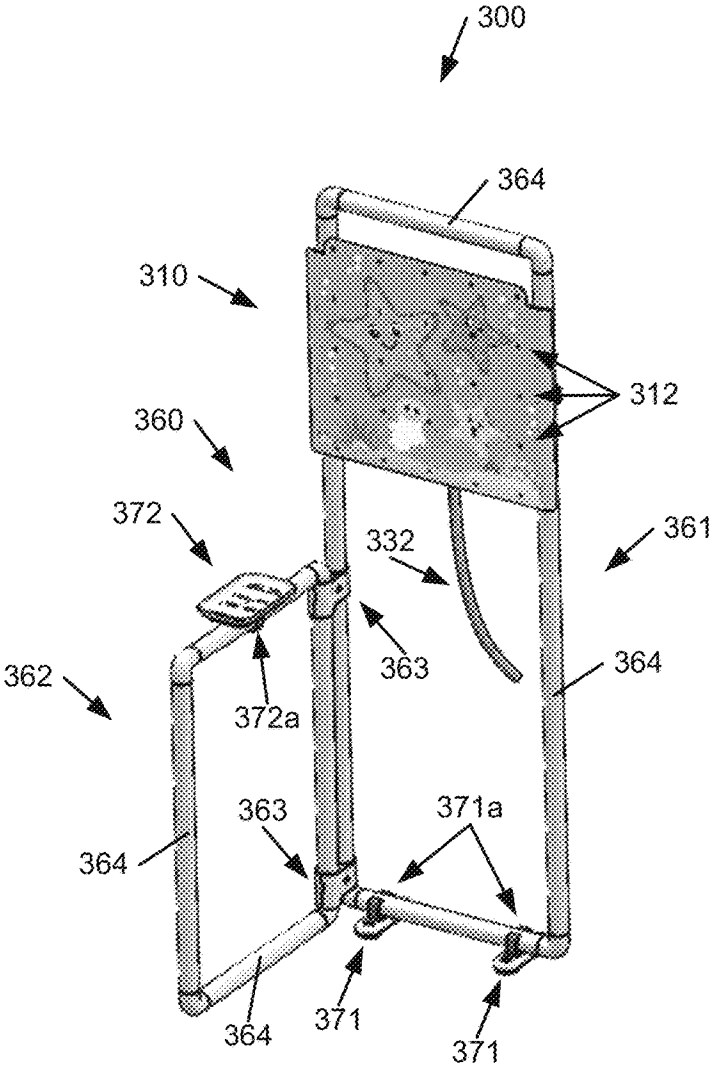
Figure 4C:
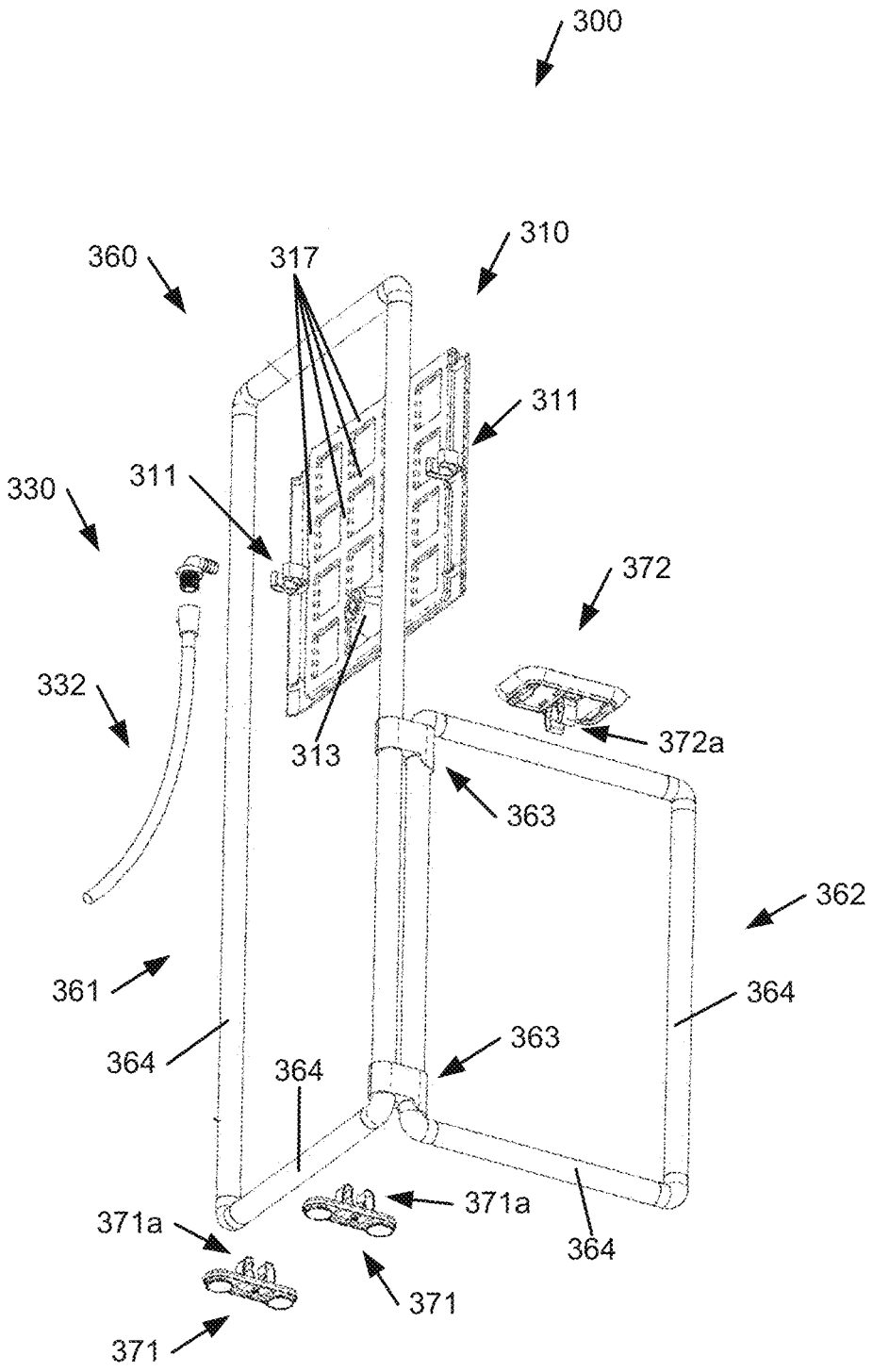

FIGS. 4A-4G and 5A-5H illustrate another implementation of an example miniature shower for toddlers 300 according to the present disclosure. FIGS. 4A and 5C-5H show profile views of the miniature shower for toddlers 300 in a usage (or in-use) configuration. FIGS. 4B and 5A show profile views of the miniature shower for toddlers 300 in a storage or carry configuration. FIG. 4C shows an exploded profile view of the miniature shower for toddlers 300.

Figure 4D:
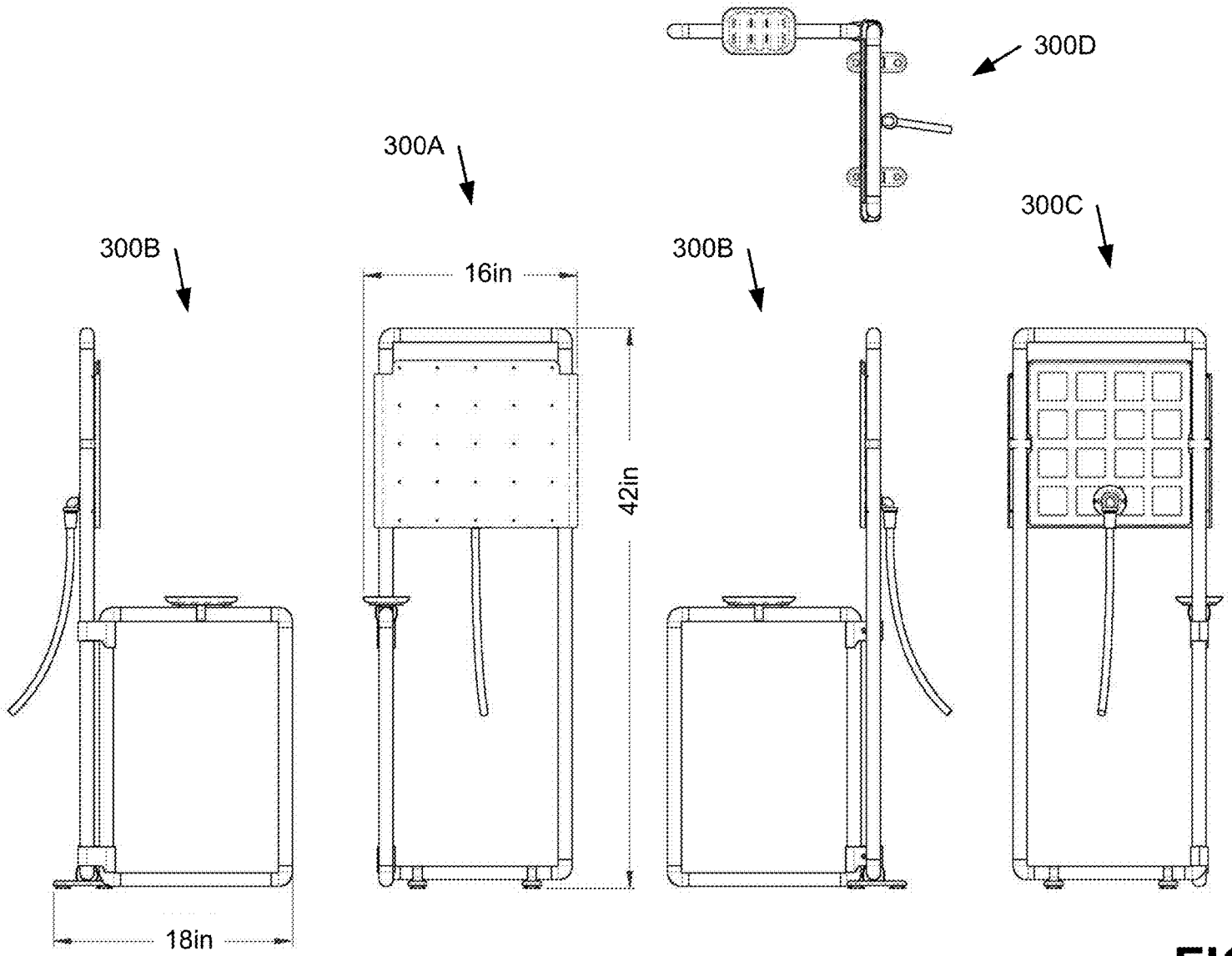
Figure 4F:
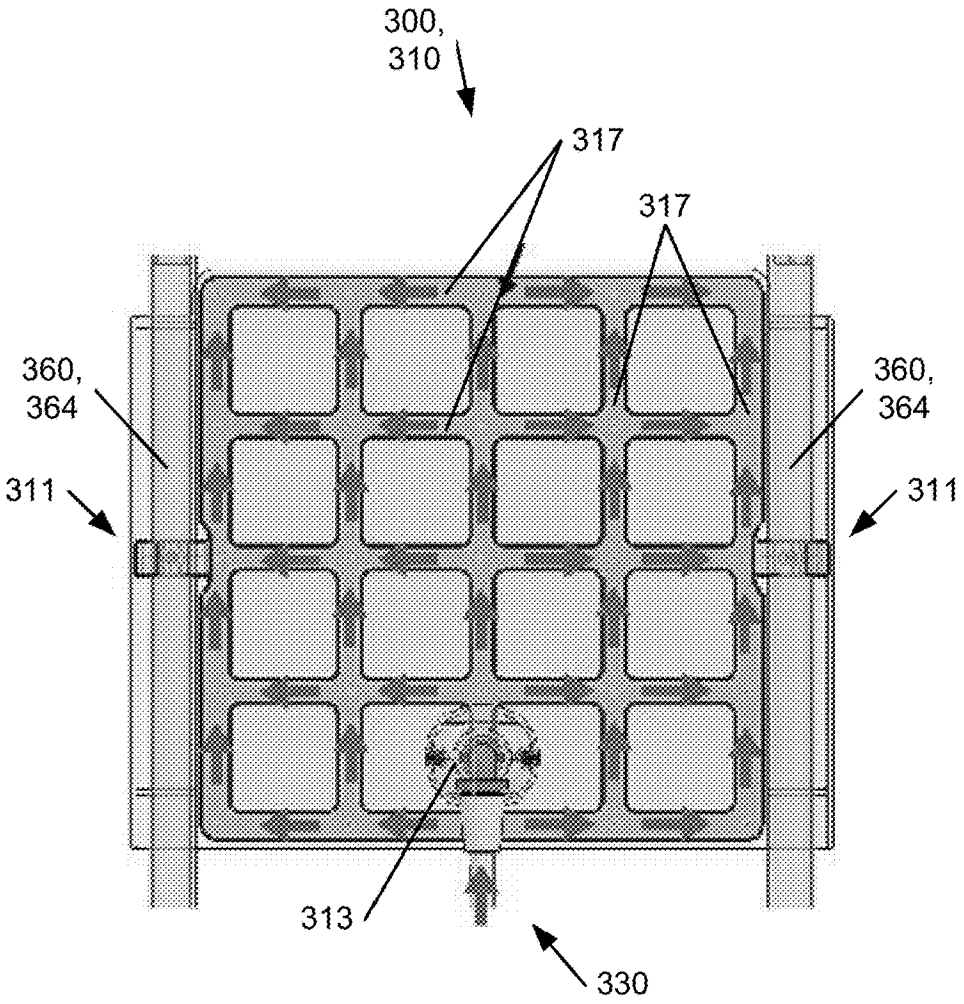
Figure 4E:
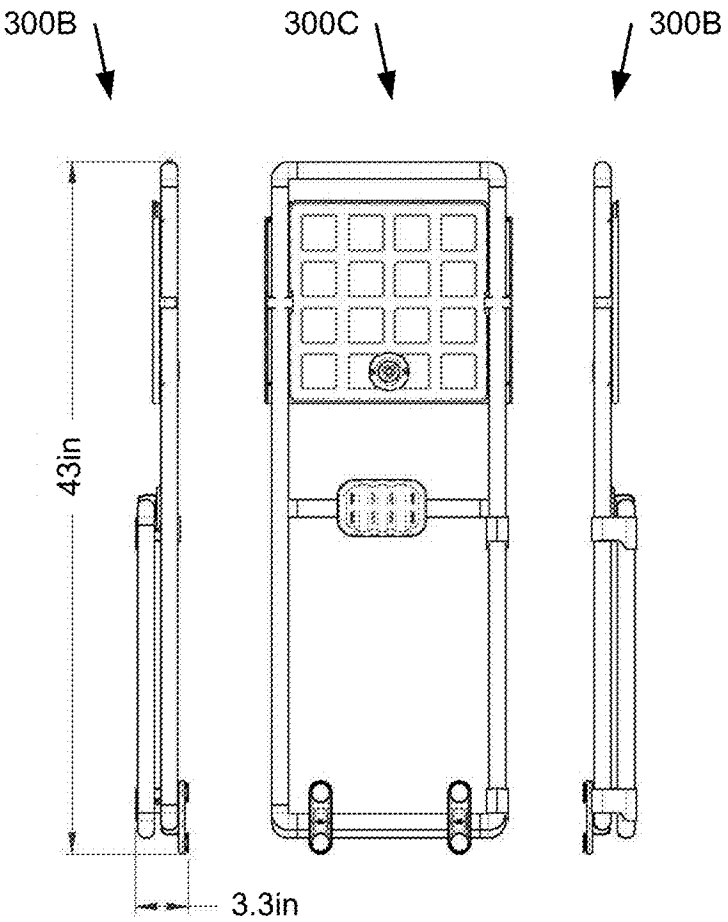
Figure 4G:
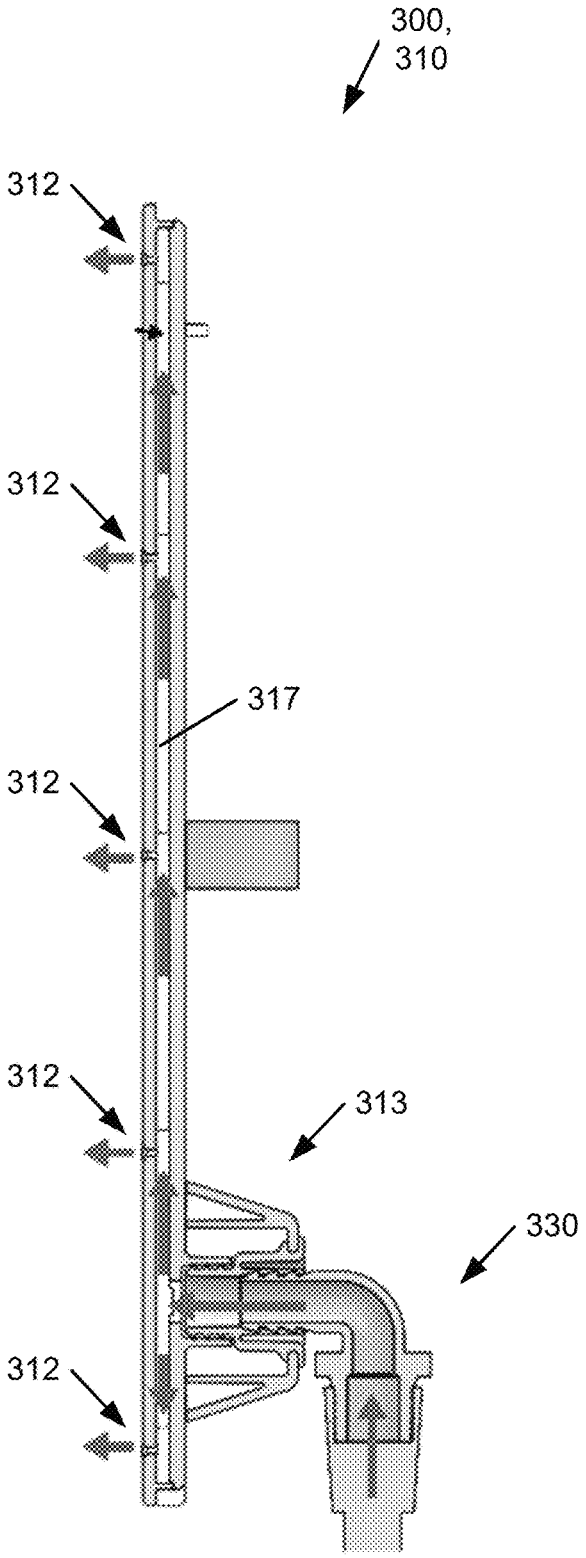
Figure 5A:
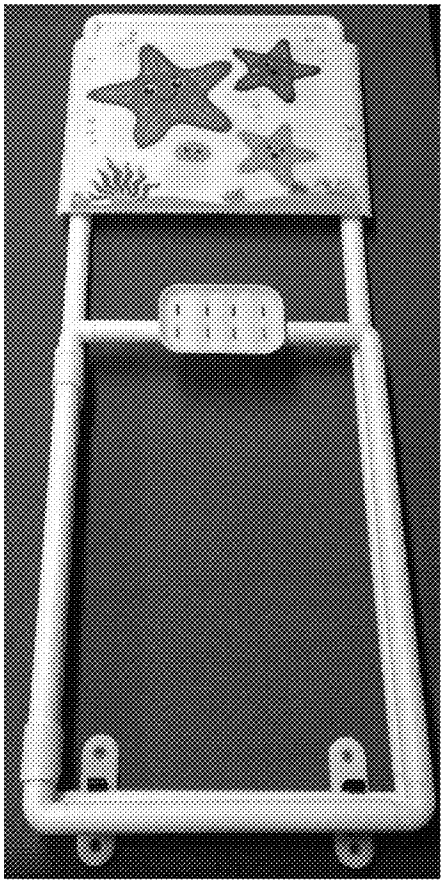
Figure 5B:
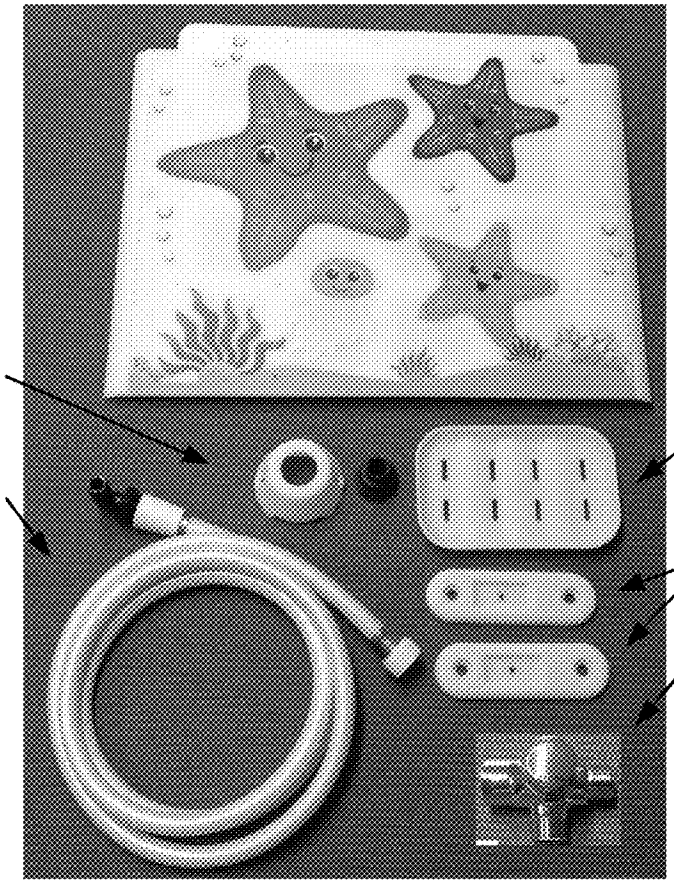

FIG. 4D shows front (300A), side (300B), back (300C), and top (300D) views of the miniature shower for toddlers 300 in the use configuration. FIG. 4E shows side (300B) and back (300C) views of the miniature shower for toddlers 300 in the storage or carry configuration. FIGS. 4F and 4G show back and side views of the miniature shower for toddlers 300 illustrating an example water flow into, through, and out of the miniature shower for toddlers 300. FIG. 5B shows various components of the miniature shower for toddlers 300 in an unassembled configuration.

In some implementations, the miniature shower for toddlers 300 is generally the same or similar to the miniature shower for toddlers 100 described above for FIGS. 2A-2F. For example, as shown in FIG. 4A, in some implementations, the miniature shower for toddlers 300 comprises at least one wall 310 that is generally the same or similar to the above described walls 110 of the miniature shower for toddlers 100.

As shown in FIGS. 4C and 5B, in some implementations, the miniature shower for toddlers 300 may also comprises a water source connector 330, e.g. comprising a hose 332 and/or a diverter 333, that is the same or similar to the above described water source connector 130 of the miniature shower for toddlers 100.

As shown in FIG. 4A, in some implementations, the miniature shower for toddlers 300 further comprises a frame or support 360. In some implementations, the miniature shower for toddlers 300 may further comprise one or more additional (e.g., accessory) components such as a one or more support feet ("feet") 371 and a holding dish ("dish") 372.

As shown in FIGS. 4F and 4G, in some implementations, the wall 310 is or comprises a manifold. That is, in some implementations, the wall 310 is configured to receive water into the water input opening 313, distribute the water through the wall 310 to the one or more water output openings 312, and release the water through the water output openings 312. For example, as shown in FIGS. 4C and 4F, in some implementations, the wall 310 may comprise one or more channels or conduits 317 (e.g., openings, paths, pipes, tubing, etc.) configured to distribute water within the wall 310.

In some implementations, some of the channels 317 may extend generally vertically and some of the channels 317 may extend generally horizontally. As shown in FIG. 4F, in some implementations, the channels 317 may be fluidly interconnected at one or more points where the channels 317 cross each other.

Figure 5D:
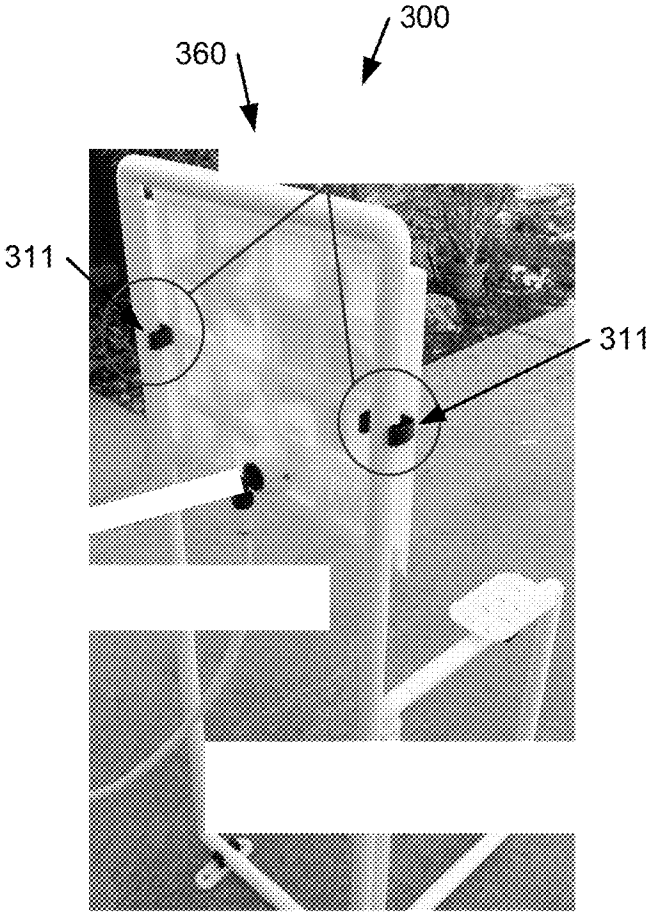

As shown in FIGS. 4C and 5D, in some implementations, the wall 310 comprises one or more components such that the wall is removably and/or movably attachable to the support 360. For example, in some implementations, the 310 comprises one or more support connectors 311 that are configured to removably and/or movably attach the wall 310 to the support 360.

As shown in FIG. 4C, in some implementations, the wall 310 may be further configured (e.g., sized and/or shaped) to attach to the support 360.

In some implementations, the wall 310 may comprise any other suitable components and/or configuration to attach to the support 360.

Figure 5C:
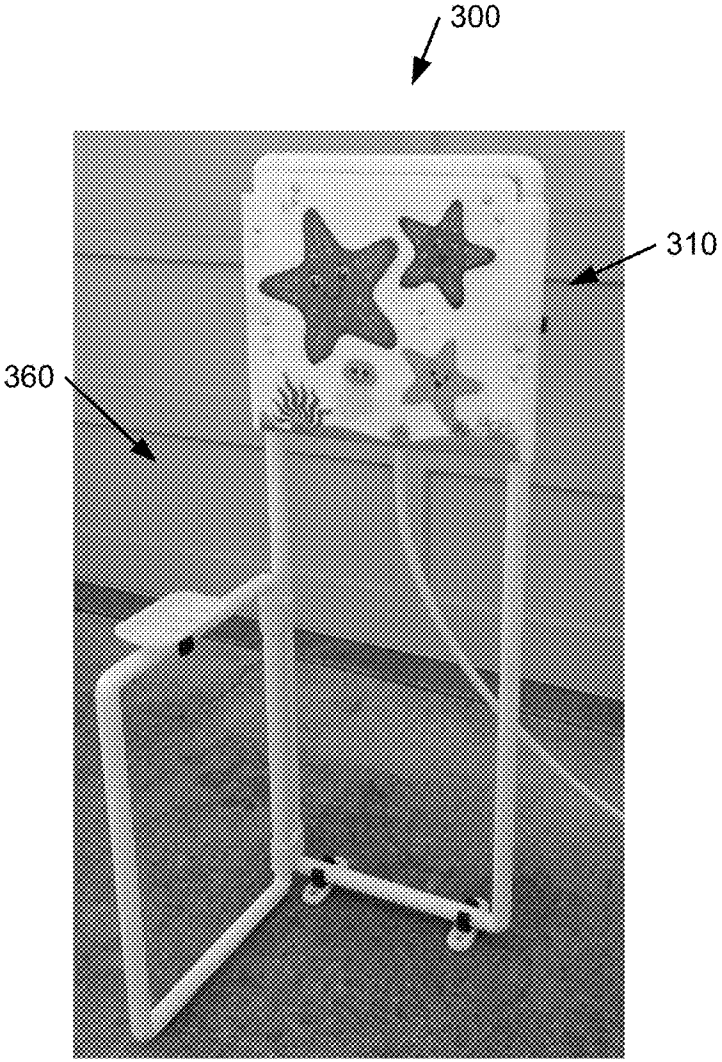
Figure 5F:
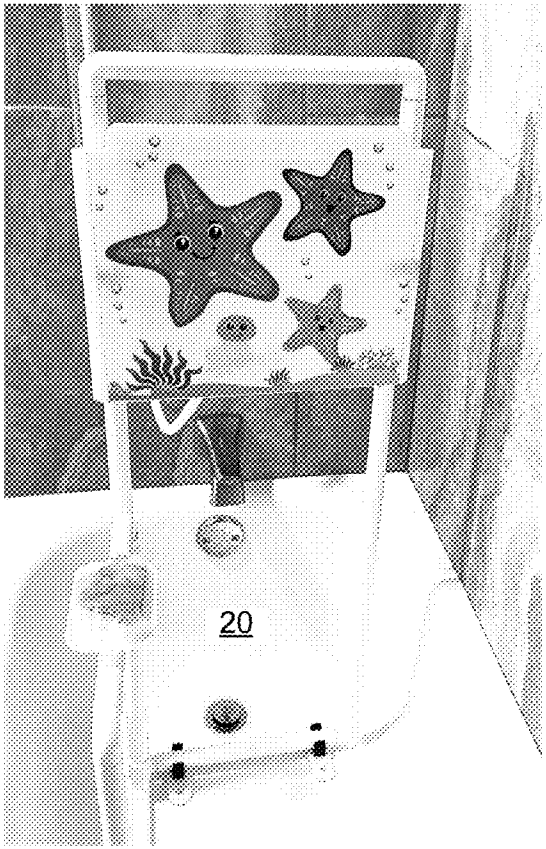
Figure 5E:
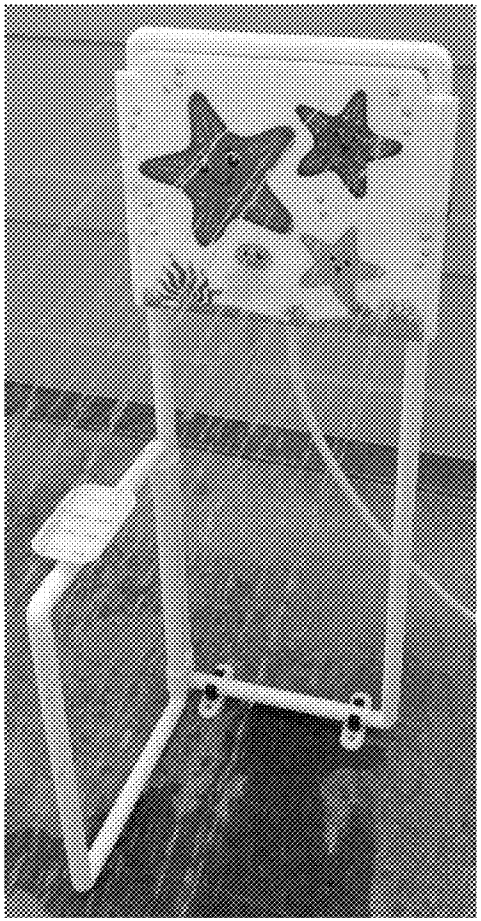
Figure 5H:
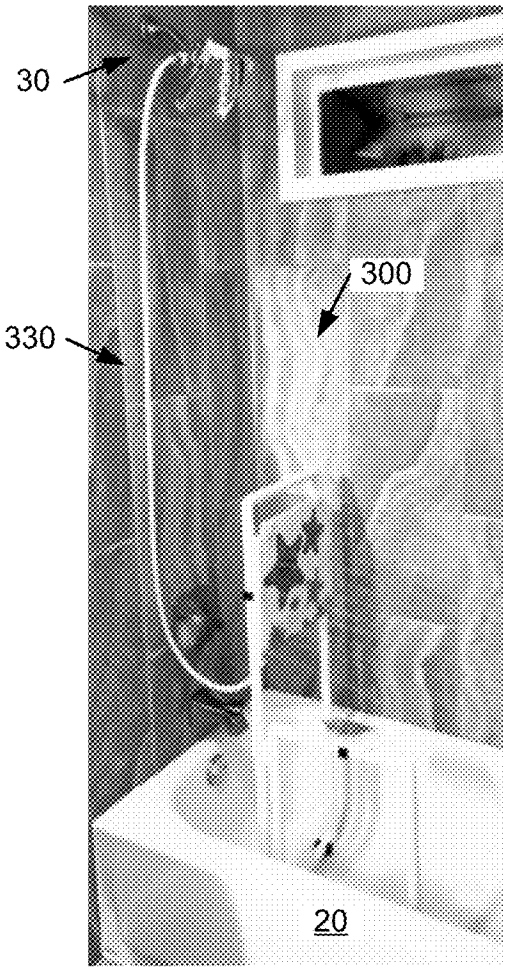
Figure 5G:
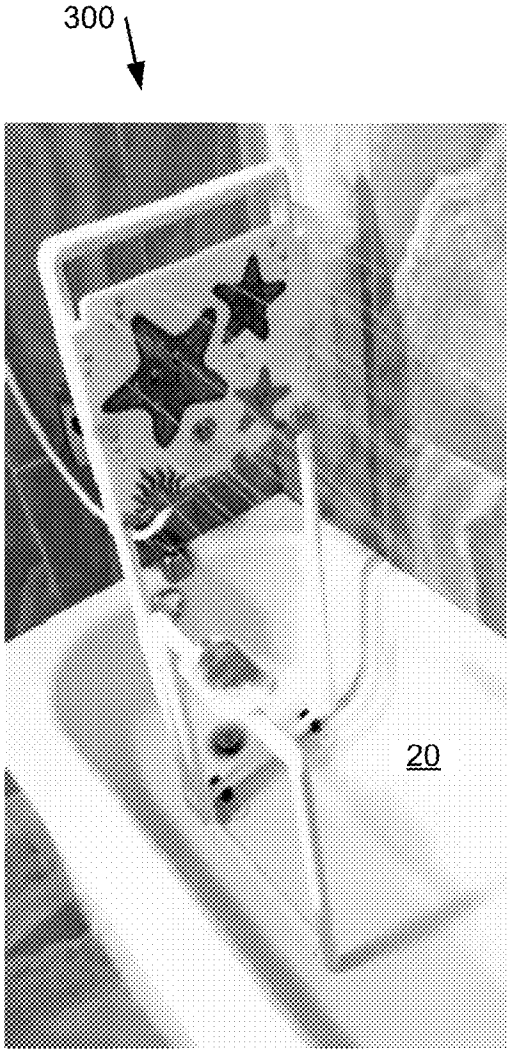

As shown in FIGS. 4A and 5C, in some implementations, the wall 310 may comprise a decorative image on a side (e.g., the front side) that faces a young or small child user when using the miniature shower for toddlers 300. In some implementations, the decorative image may be configured to be appealing to the young or small child user of the miniature shower for toddlers 300.

In some implementations, the support 360 comprises at least one section such that the support 360 allows the miniature shower for toddlers 300 to be standalone (free-standing, self-standing, etc., as further described below) on a surface such as a bathtub bottom (or floor), shower floor, or a ground surface.

As shown in FIG. 4A, in some implementations, the support 360 may comprise a first section 361 and a second section 362. In some implementations, the first section 361 may be larger (e.g., longer or taller) than the second section 362. In some implementations, the first section 361 and the second section 362 may have any other suitable size comparison.

In some implementations, the sections 361, 362 may be any suitable shape. For example, as shown in FIG. 4A, in some implementations, the sections 361, 362 may be generally rectangular shaped.

As shown in FIGS. 4A and 4B, in some implementations, the second section 362 may be movably attached to the first section 361. For example, in some implementations, the second section 362 may be attached to the first section 361 by one or more hinges or brackets 363 such that the second section 362 can fold or close together to and unfold or open apart from the first section 361.

As shown in FIG. 4A, in some implementations, the sections 361, 362 are attached such that the lower or bottom portion of the sections 361, 362 can position on a surface (such as a bathtub bottom, shower floor, or ground surface) to allow the miniature shower for toddlers 300 to be standalone, such as when the second section 362 is unfolded or opened apart from the first section 361.

As shown in FIG. 4A, in some implementations, the sections 361, 362 may comprise one or more members 364 that form each section 361, 362. For example, in some implementations, some of the members 364 may extend generally vertically and some of the members 364 may extend generally horizontally.

In some implementations, the members 364 may be any suitable shape. For example, as shown in FIG. 4A, in some implementations, the members 364 may be generally tubular shaped, such as formed by one or more pipes.

In some implementations, the support 360 may comprise any other suitable components and/or configuration.

In some implementations, the support 360 is configured to allow the miniature shower for toddlers 300 to be standalone on a surface such as a bathtub bottom (or floor), shower floor, or a ground surface, such as shown in FIGS. 5C and 5E-5H. In some implementations, the support 360 is configured to support the wall 310 at a variable height and/or other positioning above such surface to allow the use of the miniature shower for toddlers 300.

In some implementations, the feet 371 may have any suitable configuration (e.g., size and shape) that allows the feet 371 when attached to the support 360 to further allow (e.g., further stabilize) the miniature shower for toddlers 300 to be standalone on a surface such as a bathtub bottom, shower floor, or a ground surface. For example, as shown in FIGS. 4C and 5B, in some implementations, the feet 371 may be generally rectangular shaped strips.

As shown in FIGS. 4A-4C, in some implementations, the feet 371 are configured to movably and removably attach to the support 360. For example, in some implementations, the feet 371 may comprise one or more support connectors 371*a* that are the same or similar to the above described support connectors 311 of the wall 310.

In some implementations, the feet 371 may comprise any other suitable components and/or configuration to attach to the support 360.

In some implementations, the dish 372 may have any suitable configuration (e.g., size and shape) that allows the dish 372 to hold soap or other suitable items. For example, as shown in FIGS. 4A and 5B, in some implementations, the dish 372 may be generally rectangular shaped similar to a soap dish.

As shown in FIGS. 4A-4C, in some implementations, the dish 372 is configured to movably and removably attach to the support 360. For example, in some implementations, the dish 372 may comprise one or more support connectors 372*a* that are the same or similar to the above described support connectors 311 of the wall 310.

In some implementations, the dish 372 may comprise any other suitable components and/or configuration to attach to the support 360.

In some implementations, the miniature shower for toddlers 100, 200, 300 is configured to provide a miniature shower insert for bathtubs, showers, or other suitable locations for use to shower young or small children such as toddlers.

In some implementations, the miniature shower for toddlers 100, 200, 300 is configured, e.g. sized and shaped, to be used by young or small children, such as age 2 to 6 years old.

In some implementations, the miniature shower for toddlers 100, 200, 300 is portable. For example, in some implementations, the walls 110, 210 or support 360 of the miniature shower for toddlers 100, 200, 300 are foldable, closeable, or otherwise collapsible for carrying or storing the miniature shower for toddlers 100, 200, 300.

In some implementations, the miniature shower for toddlers 100, 200, 300 is configured to shower a young or small child user by spraying water below the child's head or face.

In some implementations, the miniature shower for toddlers 100, 200, 300 is configured, e.g. sized small enough, such that the miniature shower for toddlers 100, 200, 300 does not cause a young or small child user to feel overwhelmed, anxious, or otherwise uncomfortable during use.

In some implementations, the miniature shower for toddlers 100, 200, 300 is configured to position in a bathtub or shower 20 or other suitable location and function as a miniature shower for young or small children, such as shown in FIGS. 2F, 3B, 4A, and 5C.

In some implementations, the miniature shower for toddlers 100, 200, 300 is configured to provide a standalone (freestanding, self-standing, etc.), portable enclosure (or partial enclosure), such as shown in FIGS. 2F, 3B, 4A, 5C, and 5E-5H. That is, in some implementations, the miniature shower for toddlers 100, 200, 300 is configured to position, rest, etc. on such surface in an upright, standing, in-use position without additional support from other objects, such as a wall of the bathtub, shower, or other structure. Furthermore, in some implementations, the miniature shower for toddlers 100, 200, 300 is configured to be standalone such that it is unsupported, separable, detachable, and/or not integrated to such surface.

In some implementations, the miniature shower for toddlers 100, 200, 300 is configured to be adjustable in height, for example by use of the wall extensions 150 or by the positioning of the wall 310 on the support 360.

In some implementations, the miniature shower for toddlers 100, 200, 300 is configured to output water in a spread out or surrounding pattern such that a showerhead or a young or small child user does not have to be moved around to spread the water for showering.

In some implementations, the miniature shower for toddlers 100, 200, 300 is configured to output water at an adjustable height or other configuration for showering, for example by use of the water control valves 114.

In some implementations, the miniature shower for toddlers 100, 200, 300 is configured to secure to a bathtub, shower, or other suitable surface, location, etc. by the attachment mechanism, such as suction cups, or in any other suitable way.

In some implementations, the miniature shower for toddlers 100, 200, 300 is configured to connect to a water source 30, such as a showerhead supply pipe (or shower arm), a bathtub water spout, such as shown in FIGS. 2F and 3B, or a water faucet (e.g., indoor or outdoor). In some implementations, the miniature shower for toddlers 100, 200, 300 is configured to connect to a plumbing system in general (i.e., any other suitable part thereof), such as a plumbing system of an existing structure such as a house, building, etc.

In some implementations, the miniature shower for toddlers 100, 200, 300 comprises any suitable dimensions, such as the example dimensions shown in FIGS. 2D, 4D, and 4E. For example, in some implementations, the miniature shower for toddlers 100, 200, 300 may be approximately 16 inches wide and approximately 42 inches long (i.e., in height). In some implementations, the miniature shower for toddlers 100, 200, 300 may be less than 16 inches wide and/or less than 42 inches long. In some implementations, the miniature shower for toddlers 100, 200, 300 may be greater than 16 inches wide and/or greater than 42 inches long.

In some implementations, the miniature shower for toddlers 100, 200, 300 may be at least 16 inches wide and at least 42 inches long (i.e., in height). In some implementations, the miniature shower for toddlers 100, 200, 300 may be at most 16 inches wide and/or at most 42 inches long. In some implementations, the miniature shower for toddlers 100, 200, 300 may be any other suitable width and/or length.

In some implementations, the miniature shower for toddlers 100, 200, 300 is composed of any suitable materials. For example, in some implementations, the walls 110, 210, 310 and related components such as the wall extensions 150, the support 360, and the hinges 120, 220, 363 may be composed of any suitable plastic materials.

In some implementations, the miniature shower for toddlers 100, 200, 300 can have any suitable appearance, such as the examples shown in the figures.

In some implementations, an example method of using the miniature shower for toddlers 100, with respect to the above-described figures, comprises opening or spreading apart the walls 110 to a desired position, such as shown in FIG. 2A. In some implementations, the walls 110 may be previously positioned in a closed together position for carrying or storing the miniature shower for toddlers 100.

In some implementations, the method comprises positioning the miniature shower for toddlers 100 on a suitable surface, such as a bathtub bottom (or floor) or shower floor (or a ground surface), such as shown in FIG. 2F. In some implementations, the method may further comprise securing the miniature shower for toddlers 100 to the surface, such as by the suction cups or other suitable attachment mechanisms.

In some implementations, the method comprises connecting the miniature shower for toddlers 100 to a water source. For example, as shown in FIG. 2F, in some implementations, the water source connector 130 is connected to a water source 30 such as a showerhead supply pipe, bathtub water spout, or a water faucet (or any other suitable part of a plumbing system, such as of an existing structure), and to the water input opening 113.

In some implementations, the method comprises positioning a young or small child adjacent to the water output openings 112 and turning on the water supply to the miniature shower for toddlers 100 such that the child is showered by water from the water output openings 112.

In some implementations, the method may further comprise adjusting the height of the water output openings 112 to correspond to the size or height of the young or small child user. For example, in some implementations, the height may be increased by attaching the wall extensions 150 to the walls 110. In some implementations, the height may be decreased by turning off the water output from one or more upper rows of water output openings 112.

In some implementations, the water control valves 114 may be turned on, off, or suitably adjusted to vary the water output from the water output openings 112 in any other suitable way.

In some implementations, the method may further comprise turning off, disconnecting, removing, folding, and carrying or storing the miniature shower for toddlers 100 by reversing the above described method steps.

In some implementations, an example method of using the miniature shower for toddlers 200, with respect to the above-described figures, comprises the same or similar steps as described above for the miniature shower for toddlers 100 using the corresponding components and features of the miniature shower for toddlers 200.

In some implementations, an example method of using the miniature shower for toddlers 300, with respect to the above-described figures, comprises unfolding or opening apart the sections 361, 362 of the support 360 to a standalone (freestanding, self-standing, etc., as further described above) configuration, such as shown in FIG. 4A. In some implementations, the sections 361, 362 may be previously positioned in a folded or closed together configuration for storing or carrying the miniature shower for toddlers 300.

In some implementations, the method comprises positioning the miniature shower for toddlers 300 on a suitable surface, such as a bathtub bottom, shower floor, or ground surface, such as shown in FIGS. 5C and 5E-5H. In some implementations, the method may further comprise securing the miniature shower for toddlers 300 to the surface, such as by the feet 371, suction cups, or other suitable attachment mechanisms.

In some implementations, the method comprises attaching (or otherwise positioning) the wall 310 to the support 360 at a desired height and/or other suitable position. For example, the wall 310 may be attached to the support 360 at a height such that the miniature shower for toddlers 300 sprays water below the a young or small child user's head or face.

In some implementations, the method comprises connecting the miniature shower for toddlers 300 to a water source. For example, in some implementations, the water source connector 330 is connected to a water source 30 such as a showerhead supply pipe, bathtub water spout, or a water faucet (or any other suitable part of a plumbing system, such as of an existing structure), and to the water input opening 313.

In some implementations, the method comprises positioning a young or small child adjacent to the water output openings 312 and turning on the water supply to the miniature shower for toddlers 300 such that the child is showered by water from the water output openings 312.

In some implementations, the method may further comprise further adjusting the height of the water output openings 312 to correspond to the size or height of the young or small child user. For example, in some implementations, the height may be adjusted by removing and reattaching the wall 310 to the support 360 at the desired height.

In some implementations, the method may further comprise turning off, disconnecting, removing, folding, and carrying or storing the miniature shower for toddlers 300 by reversing the above described method steps.

The figures, including photographs and drawings, comprised herewith may represent one or more implementations of the miniature shower for toddlers.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A miniature shower comprising:

a first frame support defining a first area and second frame support defining a second area wherein the first frame support is moveably attached to the second frame support such that the second frame support can be moved away from or toward the first frame support in an opening or closing manner respectively such that when the miniature shower is closed, the second frame support is positioned on top of the first frame support when the first frame support and second frame support are positioned horizontally; and a water spraying surface comprising a plurality of openings each configured to deliver a continuous stream of water when the structure is attached to a water source wherein the water spaying surface is movably attached to the first frame support to adjust the height of the water spraying surface when the first frame support is oriented in a vertical position; wherein the miniature shower is configured to rest on a surface without support from an existing wall when the first frame support and second frame support are oriented to extend lengthwise in a vertical direction.

2. The miniature shower of claim 1 wherein the first frame support and second frame support are free-standing.

3. The miniature shower of claim 1 further comprising a container configured to store a soap bar wherein the container is removably attached to the first frame support or second frame support.

4. The miniature shower of claim 1 further wherein the water spraying surface is removably attached to the first frame support.

5. The miniature shower of claim 1 further comprising one or more elongated structures configured to attach beneath the first frame support or second frame support to provide additional stability wherein the one or more elongated structures are removably attachable to the first frame support or second frame support.

6. The miniature shower of claim 5 wherein the one or more elongated structures comprise suction cups.

7. The miniature shower of claim 1 wherein the first frame support and second frame support are foldable for carrying or storing the miniature shower.

8. The miniature shower of claim 1 wherein the first frame support and second frame support are no more than 42 inches in height.

9. A method of using the miniature shower of claim 1 comprising:

attaching the water spraying surface to the first frame support at a height such that when the miniature shower is in use, the water from the water spraying surface is below the child's face.

10. A miniature shower comprising:

a first frame support defining a first area and second frame support defining a second area wherein the first frame support is moveably attached to the second frame support such that the second frame support can be moved away from or toward the first frame support in an opening or closing manner respectively such that when the miniature shower is closed, the second frame support is positioned on top of the first frame support when the first frame support and second frame support are positioned horizontally;

a water spraying surface comprising a plurality of openings each configured to deliver a continuous stream of water when the structure is attached to a water source wherein the water spaying surface is removably and movably attached to the first frame support to adjust the height of the water spraying surface when the first frame support is oriented in a vertical position;

a container configured to store a soap bar wherein the container is removably attached to the first frame support or second frame support; and one or more elongated structures configured to attach beneath the first frame support or second frame support to provide additional stability wherein the one or more elongated structures are removably attachable to the first frame support or second frame support wherein, the miniature shower is configured to rest on a surface without support from an existing wall when the first frame support and second frame support are oriented to extend lengthwise in a vertical direction; and the first frame support and second frame support are no more than 42 inches in height.

* * * * *